US010734186B2

(12) United States Patent
Gorrilla

(10) Patent No.: US 10,734,186 B2
(45) Date of Patent: Aug. 4, 2020

(54) SYSTEM AND METHOD FOR IMPROVING X-RAY PRODUCTION IN AN X-RAY DEVICE

(71) Applicant: GENERAL ELECTRIC COMPANY, Schenectady, NY (US)

(72) Inventor: Michael William Gorrilla, Wauwatosa, WI (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 227 days.

(21) Appl. No.: 15/847,047

(22) Filed: Dec. 19, 2017

(65) Prior Publication Data

US 2019/0189386 A1 Jun. 20, 2019

(51) Int. Cl.

*H01J 35/10* (2006.01)
*H01J 35/12* (2006.01)
*H01J 35/08* (2006.01)

(52) U.S. Cl.

CPC ..... *H01J 35/105* (2013.01); *H01J 2235/1204* (2013.01)

(58) Field of Classification Search

CPC ..... H01J 2235/1204; H01J 35/105; H01J 2235/1208; H01J 2235/1262; H01J 35/106; H01J 35/10; H01J 2235/083; H01J 2235/081; H01J 2235/084; H01J 2235/1006; H01J 2235/106; H01J 2235/1225; H01J 35/08; H01J 35/116; H01J 2235/1233; H01J 2235/1291; H01J 2235/02; H01J 2235/086; H01J 35/24; H01J 35/305; H01J 2235/1287; H01J 35/108; H01J 35/14; H01J 35/18; H01J 1/36; H01J 1/44; G01N 2223/419; G01N 23/046; G21K 1/025

USPC ..... 378/127, 144, 142, 143

See application file for complete search history.

(56) References Cited

U.S. PATENT DOCUMENTS 5,056,127 A * 10/1991 Iversen ..... H01J 35/106 165/142
6,430,260 B1 * 8/2002 Snyder ..... H01J 35/106 378/130
7,197,119 B2 * 3/2007 Freudenberger ..... H01J 35/105 378/127
8,243,884 B2 * 8/2012 Rodhammer ..... C22C 26/00 378/119

(Continued)

*Primary Examiner* — Irakli Kiknadze
(74) *Attorney, Agent, or Firm* — Grogan, Tuccillo & Vanderleeden, LLP

(57) ABSTRACT

An x-ray device is presented. The x-ray device includes a cathode configured to emit an electron beam. Also, the x-ray device includes an anode configured to rotate about a longitudinal axis of the x-ray device and positioned to receive the emitted electron beam, where the anode includes a target element disposed on an anode surface of the anode and a track element embedded in the target element, where the track element is configured to generate x-rays in response to the emitted electron beam impinging on a focal spot on the track element, where at least a portion of the track element is configured to transition from a first phase to a second phase based on heat generated in at least a portion of the track element, and where at least the portion of the track element is configured to distribute the generated heat across the anode.

20 Claims, 4 Drawing Sheets

(56) References Cited

U.S. PATENT DOCUMENTS

| | | | | |
|---|---|---|---|---|
| 8,553,844 | B2 * | 10/2013 | Lewalter | H01J 35/108 378/125 |
| 9,449,782 | B2 * | 9/2016 | Poquette | H01J 35/105 |

* cited by examiner

SYSTEM AND METHOD FOR IMPROVING X-RAY PRODUCTION IN AN X-RAY DEVICE

BACKGROUND

Embodiments of the present specification relate generally to an x-ray device, and more specifically to a system and method for improving x-ray production and distributing heat in an anode of the x-ray device.

Traditional x-ray imaging systems typically include an x-ray source and a detector array. The x-ray source generates x-rays that pass through an object being imaged. These x-rays are attenuated while passing through the object and are received by the detector array. Further, the detector array includes detector elements that produce separate electrical signals indicative of the attenuated x-rays received by each detector element. Also, the electrical signals are transmitted to a data processing system for analysis, which ultimately produces an image of the object.

Typically, the x-ray source includes an anode and a cathode that are disposed in a vacuum chamber having a high voltage (HV) environment. The anode includes a focal track that is made of a relatively high atomic number material such as tungsten or molybdenum. Further, the cathode emits electrons that impinge on the focal track of the anode to generate the x-rays. While generating the x-rays, a substantial portion of the electrons that strike the focal track of the anode may generate heat in the anode. This generated heat may increase the temperature of the anode and result in damage to the anode. Thus, it is desirable to dissipate or distribute the heat generated in the anode.

In a conventional system, the anode is rotated at high angular velocities to move the focal track that is aligned with the electrons. As the focal track rotates, areas on the focal track that are not struck by the electrons may cool down through radiant dissipation of the heat. Though some heat is dissipated through radiant heat transfer, heat that builds up in the anode is frequently greater than the amount of heat dissipated from the anode. Consequently, the anode may be over-heated and may be permanently damaged. Moreover, if the anode is over-heated, cracks or pits are formed on an outer surface of the anode that is facing the cathode. These cracks or pits on the outer surface result in a reduction in x-ray emission and may adversely impact the efficiency of generation of the x-rays in the x-ray system.

BRIEF DESCRIPTION

Briefly, in accordance with one aspect of the present specification, an x-ray device is presented. The x-ray device includes a cathode configured to emit an electron beam. Also, the x-ray device includes an anode configured to rotate about a longitudinal axis of the x-ray device and positioned to receive the emitted electron beam, where the anode includes a target element disposed on an anode surface of the anode and a track element embedded in the target element, where the track element is configured to generate x-rays in response to the emitted electron beam impinging on a focal spot on the track element, where at least a portion of the track element is configured to transition from a first phase to a second phase based on heat generated in at least a portion of the track element, and where at least the portion of the track element is configured to distribute the generated heat across the anode.

In accordance with another aspect of the present specification, a method for improving x-ray production in an x-ray device is presented. The method includes rotating an anode of the x-ray device about a longitudinal axis of the x-ray device, where the anode comprises a target element disposed on an anode surface of the anode and a track element embedded in the target element. Also, the method includes emitting, by a cathode of the x-ray device, an electron beam. Further, the method includes generating, by the track element of the anode, x-rays in response to the emitted electron beam impinging on a focal spot on the track element, where at least a portion of the track element transitions from a first phase to a second phase based on heat generated in at least a portion of the track element. In addition, the method includes distributing, by at least the portion of the track element, the generated heat across the anode.

In accordance with yet another aspect of the present specification, an x-ray system is presented. The x-ray system includes a housing. Also, the x-ray system includes an x-ray device disposed within the housing, where the x-ray device includes a cathode configured to emit an electron beam, an anode configured to rotate over a longitudinal axis of the x-ray device and positioned to receive the emitted electron beam, where the anode includes a target element on an anode surface of the anode and a track element embedded in the target element, where the track element is configured to generate x-rays in response to the emitted electron beam impinging on a focal spot on the track element, where at least a portion of the track element is configured to transition from a first phase to a second phase based on heat generated in at least the portion of the track element, and where at least the portion of the track element is configured to distribute the generated heat across the anode.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

As will be described in detail hereinafter, various embodiments of exemplary structures and methods for improving x-ray production and distributing heat generated in an x-ray device are presented. By employing the methods and the various embodiments of the x-ray device described hereinafter, x-rays are produced without degrading an anode in the x-ray device. Also, the heat that is generated during the production of x-rays is distributed across the anode in the x-ray device. As a result, the anode is prevented from getting damaged. Moreover, use of the exemplary structures and methods aids in maintaining the anode without cracks or pits, which in turn improves the efficiency of generation of x-rays in the x-ray device.

Figure 1:
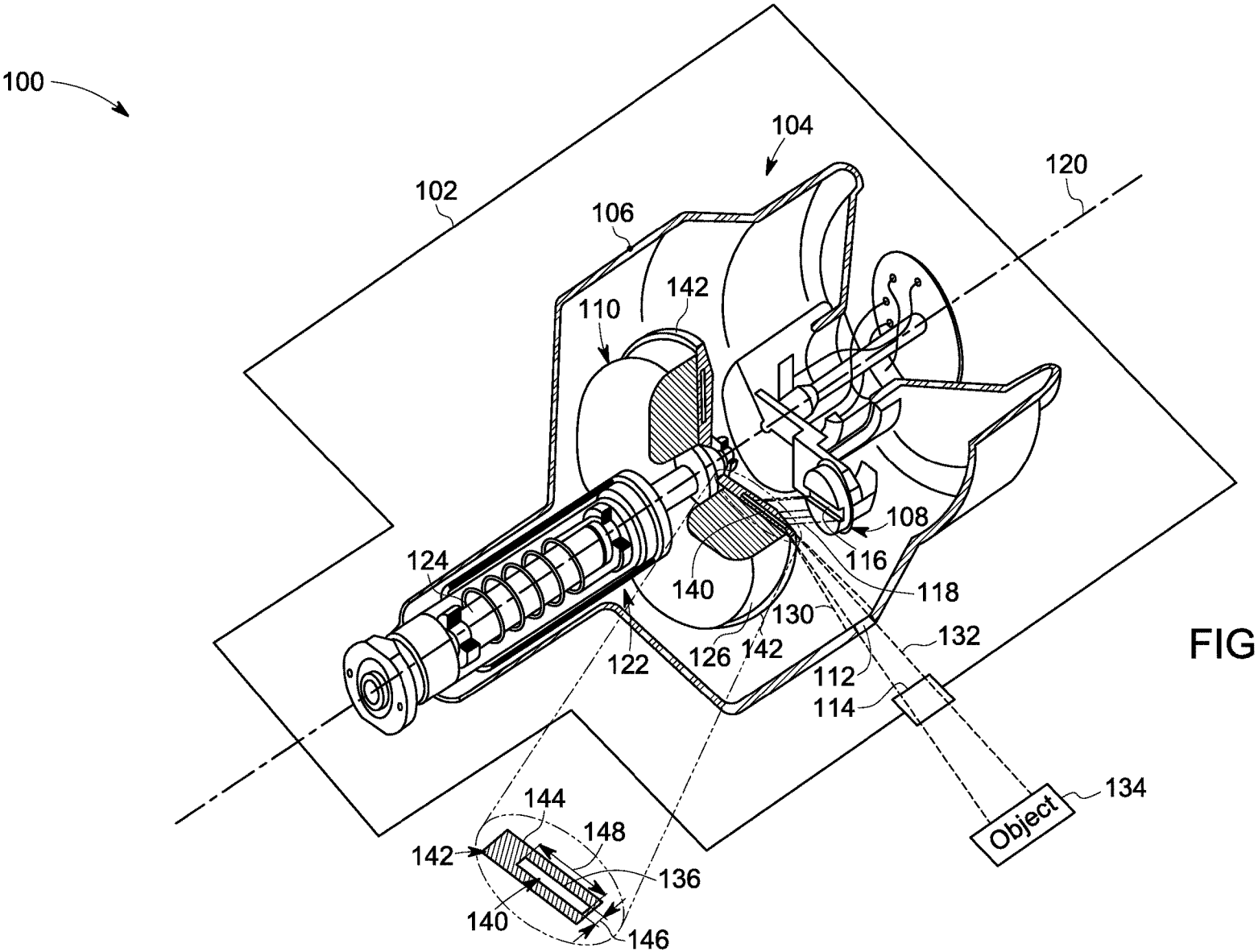
FIG. 1 is a perspective view of an x-ray device, in accordance with aspects of the present specification.

Referring to FIG. 1, a perspective view of an x-ray system 100, in accordance with aspects of the present specification, is depicted. For ease of understanding, a partial cross-sectional view of the x-ray system 100 is depicted in FIG. 1. The x-ray system 100 may be used for medical diagnostic examinations or diagnostic examination of other objects such as, but not limited to luggage, packages, and the like.

In a presently contemplated configuration, the x-ray system 100 includes a housing 102 and an x-ray device 104 that is disposed within the housing 102. Further, the housing 102 includes a coolant that is used for cooling the x-ray device 104. In one example, the coolant may include transformer oil or water. It may be noted that the x-ray system 100 may include other components, and is not limited to the components shown in FIG. 1. The housing 102 may have any structure, and is not limited to the structure shown in FIG. 1. Also, the housing 102 may have one or more ports for coupling the components in the housing 102 with external components (not shown).

Furthermore, in a presently contemplated configuration, the x-ray device 104 includes a vacuum envelope 106, a cathode 108, and an anode 110. Further, the cathode 108 and the anode 110 are positioned within the vacuum envelope 106. The vacuum envelope 106 has a high voltage and stable vacuum environment. The vacuum envelope 106 may be an evacuated enclosure that is positioned within the housing 102 of the x-ray system 100. Also, the vacuum envelope 106 includes an x-ray window 112 that is aligned with another x-ray window 114 in the housing 102. It may be noted that the terms "vacuum envelope" and "evacuated enclosure" may be used interchangeably.

In one embodiment, the cathode 108 includes an electron source 116 for emitting electrons towards the anode 110. Particularly, an electric current is applied to the electron source 116, such as a filament, which causes electrons to be produced by thermionic emission. It may be noted that these emitted electrons are accelerated as an electron beam 118 towards the anode 110.

Furthermore, the anode 110 is configured to rotate about a longitudinal axis 120 of the x-ray device 104. The anode 110 is operatively coupled to a bearing unit 122. In one example, the bearing unit 122 includes a drive shaft 124 that is operatively coupled to the anode 110. Further, an induction motor (not shown) is used to provide a rotational force to the drive shaft 124 to rotate the anode 110 about the longitudinal axis 120 of the x-ray device 104. In certain embodiments, the induction motor includes rotor windings and stator windings.

During operation, the cathode 108 generates the electron beam 118. This electron beam 118 is accelerated towards the anode 110 by applying a high voltage potential between the cathode 108 and the anode 110. Further, the electron beam 118 impinges upon the anode 110 and releases kinetic energy in the form of electromagnetic radiation of very high frequency, i.e., x-rays 130.

The x-rays 130 emanate in all directions from the anode 110. A portion 132 of these x-rays 130 passes through the x-ray window 112 in the vacuum envelope 106 and through the x-ray window 114 of the housing 102. This portion 132 of the x-rays 130 may be utilized to examine an object 134. Some non-limiting examples of the object 134 include a material sample, a patient, or other objects of interest. These x-rays 132 are attenuated while passing through the object 134 and are received by a detector unit (not shown). Further, the detector unit includes detector elements that produce separate electrical signals indicative of the attenuated x-rays received by each detector element. Also, the electrical signals are transmitted to a data processing system (not shown). The data processing system may be configured to produce an image of the object 134 based on the electrical signals produced by the detector elements.

In a conventional x-ray device, a substantial portion of an electron beam generated by a cathode strikes a focal spot on an anode. The impinging electron beam may generate heat in the anode. This heat may in turn increase the temperature of the anode and may damage the anode. Also, this increase in temperature may cause cracks and/or pits on the anode. These cracks or pits on the anode result in a reduction in x-ray emission and may adversely impact the efficiency of generation of the x-rays in the x-ray device.

To address these shortcomings/problems of the currently available x-ray devices, the anode 110 is provided with a track element 140 that is used to prevent degrading or aging of the anode 110 and improve the generation of the x-rays in the x-ray device 104.

In the conventional x-ray device, the anode does not include a track element. Also, the anode includes material such as tungsten or molybdenum that remain in a solid phase even if excess heat is generated in the anode and a temperature of the anode is increased above a first threshold value. Consequently, cracks or pits are formed in the anode. These cracks or pits on the anode result in a reduction in x-ray emission and may adversely impact the efficiency of generation of the x-rays in the x-ray device. In one example, the first threshold value may be in a range from about 280° C. to about 350° C.

In a presently contemplated configuration, the anode 110 includes an anode surface 126 and a target element 142. Further, the target element 142 is disposed on the anode surface 126. In one example, the target element 142 may be a rotary disc that is operatively coupled to the drive shaft 124 and positioned on the anode surface 126. Also, the track element 140 is embedded in the target element 142. In one embodiment, the track element 140 may be a metallic track, while the target element 142 may be a heat sink configured to dissipate heat from the track element 140. In one example, the metallic track includes a lead material. Similarly, the heat sink includes a graphite or engineered diamond material. Accordingly, in this example, the lead material is embedded in the graphite or engineered diamond material.

In the exemplary x-ray device 104, the track element 140 is embedded in the anode 110 and more particularly in the target element 142 and positioned towards the cathode 108 to receive the electron beam 118 from the cathode 108. Also, the track element 140 is configured to transition from a solid phase to a liquid phase or vapor phase when excess heat is generated in the anode 110. By transitioning the track element 140 to the liquid state/vapor state, formation of the cracks or pits in the track element 140 is prevented even if the temperature of the track element 140 is increased above the first threshold value. Further, when the heat is dissipated from the anode 110, the track element 140 transitions back from the liquid phase or vapor phase to the solid phase, where the track element 140 in the solid phase has a uniform smooth surface. Thus, by employing the track element 140 in the anode 110, formation of cracks or pits in the anode 110 is prevented, which in-turn prevents degrading or aging of the anode 110 and improves the generation of the x-rays in the x-ray device.

Furthermore, as depicted in FIG. 1, the track element 140 is positioned/embedded proximate to an outer surface 144 of the target element 142. More particularly, the track element 140 is embedded proximate to the outer surface 144 of the target element 142 such that the emitted electron beam 118 penetrates through the target element 142 and impinges on the focal spot on the track element 140. Also, the track element 140 is positioned along a direction of the emitted electron beam 118 and configured to receive the electron beam 118 from the cathode 108. In one embodiment, the track element 140 may have a determined thickness 146 and a determined length 148. In one example, the determined thickness 146 of the track element 140 is in a range from about 1 mm to about 2 mm and the determined length 148 of the track element 140 is in a range from about 15 mm to about 30 mm.

Moreover, the cathode 108 is configured to emit the electron beam 118 and focus the electron beam 118 towards the track element 140 in the anode 110. Further, as the cathode 108 emits the electron beam 118 towards the anode 110, the electron beam 118 penetrates through the target element 142 and impinges on a focal spot on the track element 140 to generate the x-rays 130. In one example, the target element 142 includes graphite or an engineered diamond material that allows passage of the electron beam 118 and the x-rays 130 with minimal distortion or attenuation. Further, the generated x-rays 130 penetrate through the target element 142 and a portion 132 of the x-rays 130 may pass through the x-ray window 112 in the vacuum envelope 106 and through the x-ray window 114 of the housing 102. This portion 132 of the x-rays 130 may be utilized to examine the object 134.

Furthermore, the impinging electron beam 118 may generate heat in the track element 140. Also, the heat generated in the track element 140 results in an increase in the temperature of the track element 140. It may be noted that at the outset, the track element 140 is in a first, initial phase. Further, at least a portion of the track element 140 is configured to transition from the first phase to a second phase based on the heat generated in the track element 140 by the impinging electron beam 118. If the temperature of the track element 140 exceeds the first threshold value, at least the portion of the track element 140 is configured to melt and transition from the first phase to the second phase. In one example, the first threshold value may be in a range from about 280° C. to about 350° C. Also, in one example, the first phase may be representative of a solid state of the track element 140, while the second phase is representative of a liquid state of the track element 140. In one example, the track element 140 includes a lead material that melts to form a uniform surface when excess heat is generated in the anode 110.

Moreover, the track element 140, in the liquid phase, continues to generate the x-rays 130 due to the uniform surface of the track element 140. Additionally, if the temperature of the track element 140 increases above a second threshold value, at least a portion of the track element 140 is configured to transition from the second phase to a third phase. In one example, the second threshold value may be above 350° C. It may be noted that the third phase may be representative of a vapor state of the track element 140.

In addition, the track element 140 continues to generate the x-rays 130 subsequent to transitioning from the first phase to the second phase or from the second phase to the third phase. Also, the uniform surface of the track element 140 in the second phase does not have any cracks or pits, which in turn aids in improving the generation of the x-rays 130 in the x-ray system 100.

Also, the change in the phase of the track element 140 aids in distributing the heat across the anode 110. More specifically, the track element 140 is configured to absorb the generated heat when the track element 140 is transitioned from the first phase to the second phase or from the second phase to the third phase. As the anode 110 is rotated about the longitudinal axis 120 of the x-ray device 104, the track element 140 distributes the absorbed heat across the anode 110. In one example, the absorbed heat may be conveyed from the track element 140 to the target element 142 and further conveyed to the anode surface 126. In one embodiment, the coolant in the housing 102 may be used to direct this heat away from the x-ray device 104.

It may be noted that the rotation of the anode 110 may cause a high inertial load on the track element 140. This high inertial load on the track element 140 may aid in tightly coupling or securing the track element 140 to an inner wall 136 of the target element 142, for example.

In addition, distribution of the heat across the anode 110 may result in a reduction in the temperature of the track element 140 below the first threshold value. If the temperature of the track element 140 is reduced below the first threshold value, the track element 140 is configured to transition back from the second phase to the first phase. In one example, the track element 140 changes from the liquid state to the solid state. Also, the track element 140 may recreate an initial shape and structure with the uniform surface of the track element 140 facing the cathode 108.

In one embodiment, the x-ray device 104 may be deactivated after imaging the object 134. Also, the coolant in the housing 102 may aid in dissipating the distributed heat from the anode 110. As a result, the temperature of the track element 140 may drop below the first threshold value, which in turn causes the track element 140 to transition back from the second phase to the first phase. In one example, the track element 140 that is in the molten or liquid state may transition to the solid state. Also, the track element 140 maintains the uniform surface while transitioning from the liquid state to the solid state.

Thus, by employing the exemplary anode 110, the x-rays 130 are produced without degrading the track element 140 of the x-ray device 104. Also, the heat that is generated during the production of x-rays is distributed across the anode 110. As a result, the anode 110 is maintained without any cracks or pits on the surface that receives the electron beam 118. This in turn improves the efficiency of generation of the x-rays 130 in the x-ray device 104. Additionally, the anode 110 is prevented from permanent damage or aging of the anode 110.

Figure 2:
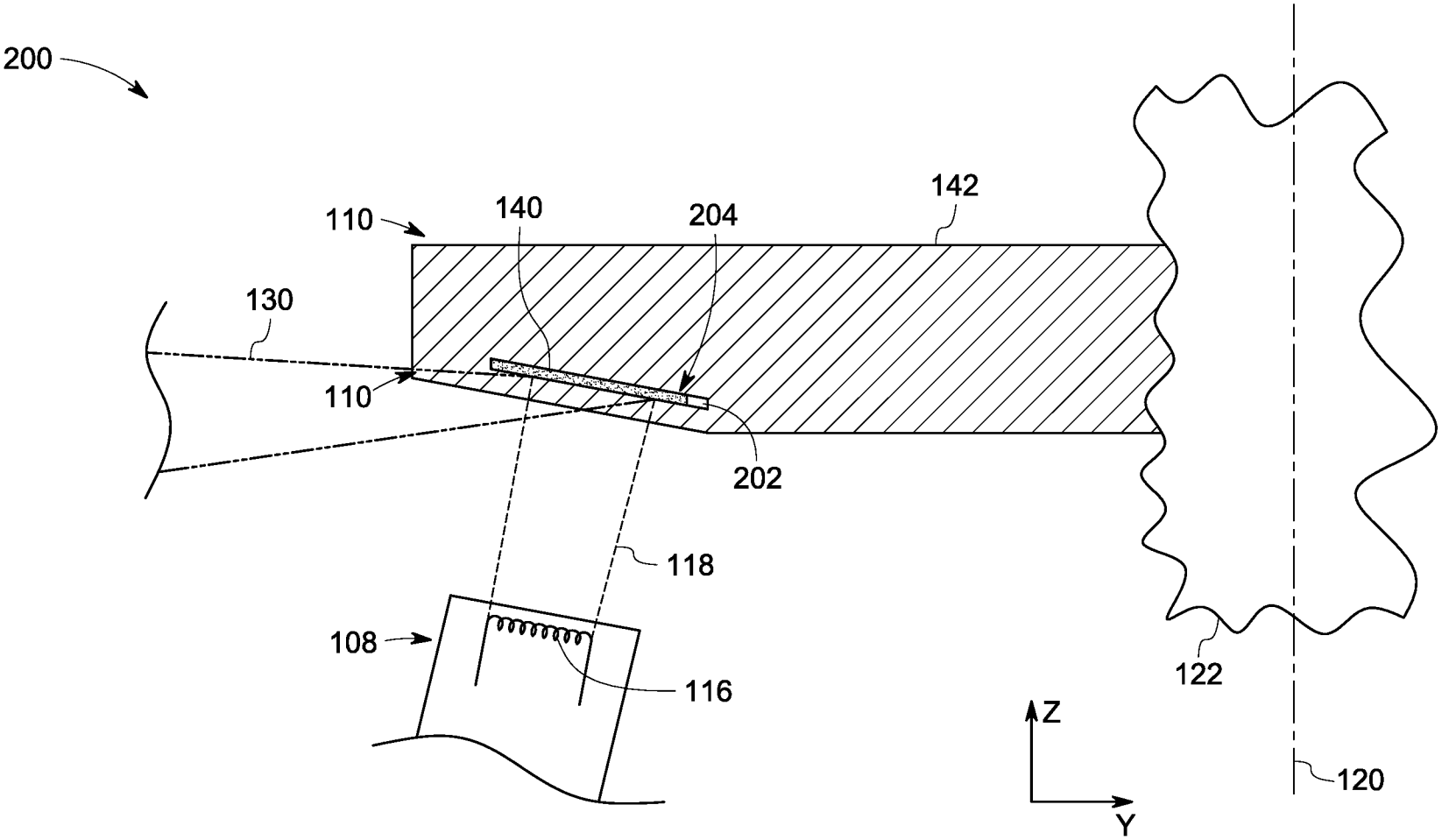
FIG. 2 is diagrammatical representation of a portion of the x-ray device of FIG. 1, in accordance with aspects of the present specification.

Referring to FIG. 2, a diagrammatical representation 200 of a portion of the x-ray device 104 of FIG. 1, in accordance with aspects of the present specification, is depicted. Also, FIG. 2 is described with reference to the components of FIG. 1.

The x-ray device 200 includes the cathode 108 and the anode 110. The anode 110 is operatively coupled to the bearing unit 122 and configured to rotate about the longitudinal axis 120 of the x-ray device 104. Also, the cathode 108 includes the electron source 116, such as a filament that is configured to emit the electron beam 118 towards the anode 110.

As depicted in FIG. 2, the anode 110 includes the target element 142 that is positioned along a direction of the emitted electron beam 118. Also, the track element 140 that is embedded in the target element 142 is positioned to receive the electron beam 118 from the cathode 108. In particular, the electron beam 118 penetrates through the target element 142 and impinges on a focal spot on the track element 140 to generate the x-rays 130. Further, the generated x-rays 130 penetrate through the target element 142 and a portion 132 of the x-rays 130 pass through the x-ray window 112 in the vacuum envelope 106 and through the x-ray window 114 of the housing 102. This portion 132 of the x-rays 130 may be utilized to examine the object 134.

Moreover, the track element 140 is embedded in the target element 142 at a determined angle with respect to the longitudinal axis 120 of the x-ray device to optimize the focal spot on the track element 140. In particular, an area of the focal spot on the track element 140 is optimized by positioning the track element 140 at the determined angle with respect to the longitudinal axis 120 of the x-ray device. By optimizing the focal spot on the track element 140, the intensity of the generated x-rays 130 impinging on the object 134 may be increased, which in turn improves the quality of an image of the object 134. The determined angle may be in a range from about 7 degrees to about 15 degrees.

Also, the target element 142 includes a void 202 adjacent to the track element 140 in the target element 142. In one example, the track element 140 is embedded in the target element 142 in such a way that an empty space is created in the target element 142 at one end of the track element 140. This empty space is representative of the void 202 in the target element 142. In one embodiment, the void 202 may be at an end 204 of the track element 140 that is closer to the longitudinal axis 120.

Moreover, at least a portion of the track element 140 is configured to expand into the void 202 when the track element 140 transitions from the first phase to the second phase. More specifically, when the heat is generated in the track element 140 due to the impinging electron beam 118, the track element 140 melts and transitions from the first phase to the second phase. Further, this molten track element 140 may expand into the void 202 that is adjacent to the track element 140. In one example, the track element 140 may expand into the void 202 due to the rotation of the anode 110. It may be noted that a size of the void 202 may be designed to allow the thermal growth or expansion of the track element 140 in the target element 142. As previously noted, by expanding the track element 140 into the void 202, the track element 140 may have a uniform surface without any cracks or pits. This uniform surface of the track element 140 may in turn improve the efficiency of generation of the x-rays 130 in the x-ray device 104.

In addition, when the track element 140 transitions back from the second phase to the first phase, the void 202 is recreated adjacent to the track element 140. More specifically, when the temperature of the track element 140 is reduced below the first threshold value, the track element 140 transitions from the second phase, such as the liquid state to the first phase, such as the solid state. Also, due to the centripetal acceleration resulting from the rotating anode 110, the track element 140 may be directed towards the circumference of the target element 142 while transitioning from the second phase to the first phase. Consequently, the void 202 is recreated at the end 204 of the track element 140 that is closer to the longitudinal axis 120.

Figure 3:
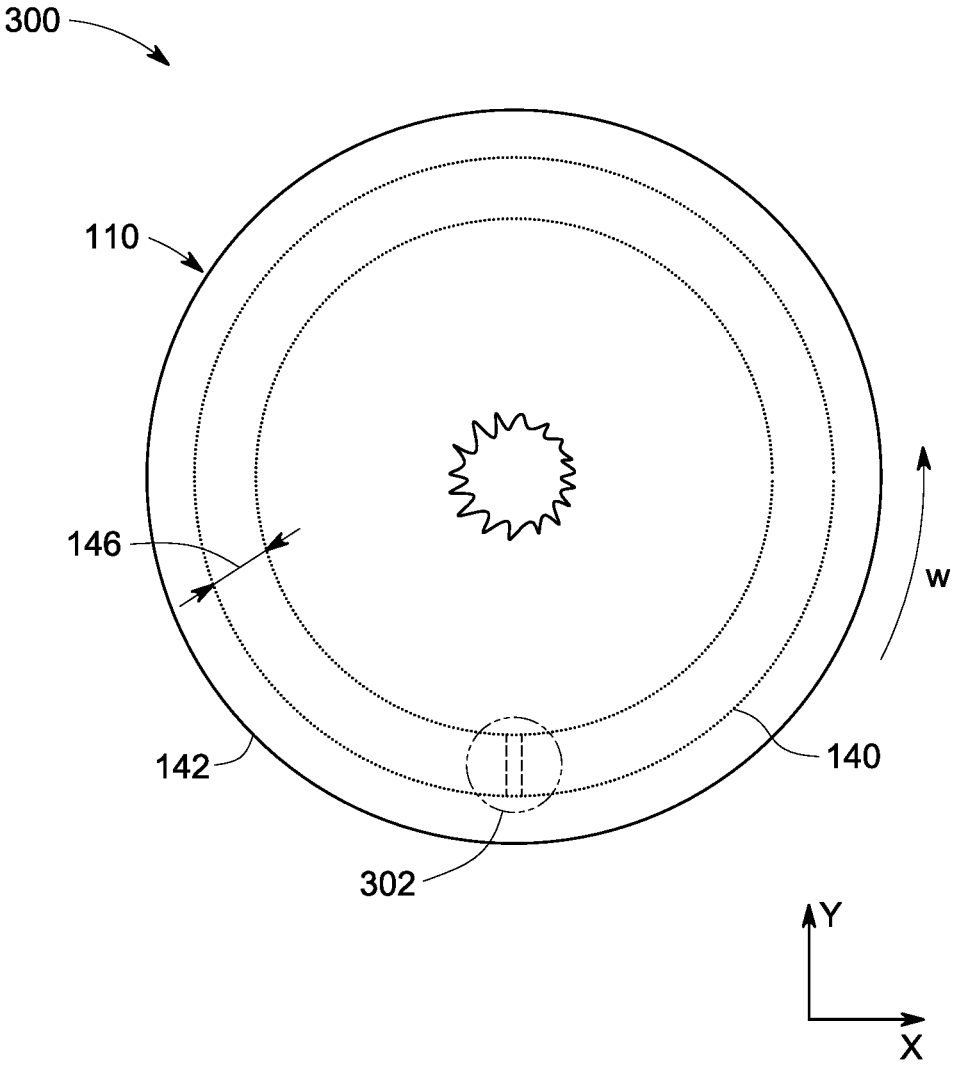
FIG. 3 is a cross sectional view of a portion of an anode of the x-ray device of FIG. 1, in accordance with aspects of the present specification.

FIG. 3 is a cross sectional view 300 of a portion of the anode 110 of the x-ray device 104 of FIG. 1, in accordance with aspects of the present specification. The anode 110 is rotated about the longitudinal axis 120 of the x-ray device 104. In FIG. 3, the anode 110 is depicted in the XY plane, while the longitudinal axis 120 of the x-ray device 104 is in the Z plane. Also, the anode 10 is rotated at a determined angular speed. In one example, the determined angular speed is in a range from about 50 Hz to about 200 Hz.

As depicted in FIG. 3, the track element 140 is embedded in the target element 142 along a circumference of the target element 142. Also, the track element 140 may have the determined thickness 146. In one example, the determined thickness may be in a range from about 15 mm to about 30 mm. Further, reference numeral 302 represents a focal spot on the track element 140. The electron beam 118 emitted from the cathode 108 impinges on this focal spot 302 to generate the x-rays 130. Also, the electron beam 118 generates heat at the focal spot 302. Due to rotation of the anode 110, different portions of the track element 140 are exposed to the electron beam 118. Thereby, heat is generated at different portions of the track element 140.

In one embodiment, at least a portion of the track element 140 may transition from the second phase to the third phase due to excess heat generated in the track element 140. In one example, the third phase is representative of a vapor state. In particular, when the temperature of the track element 140 is increased above a second threshold value, the track element 140 transitions from the second phase, such as the liquid state to the third phase, such as the vapor state. This transition of the track element 140 to the third phase may allow the track element 140 to enhance the distribution of the heat across the anode 110. Furthermore, the rotation of the anode 110 may cause at least the portion of the track element 140 in the third phase or vapor state to move towards the center of the rotating anode 110 due to the vapor having a lower density than the remaining portion of the track element 140 in the second phase. More specifically, at least the portion of the track element 140 in the third phase or vapor state may migrate away from a surface of the track element 140 facing the cathode 108. As a result, the track element 140 in the third phase or vapor state will not settle at the surface of the track element 140 and affect the generation of x-rays 130.

Figure 4:
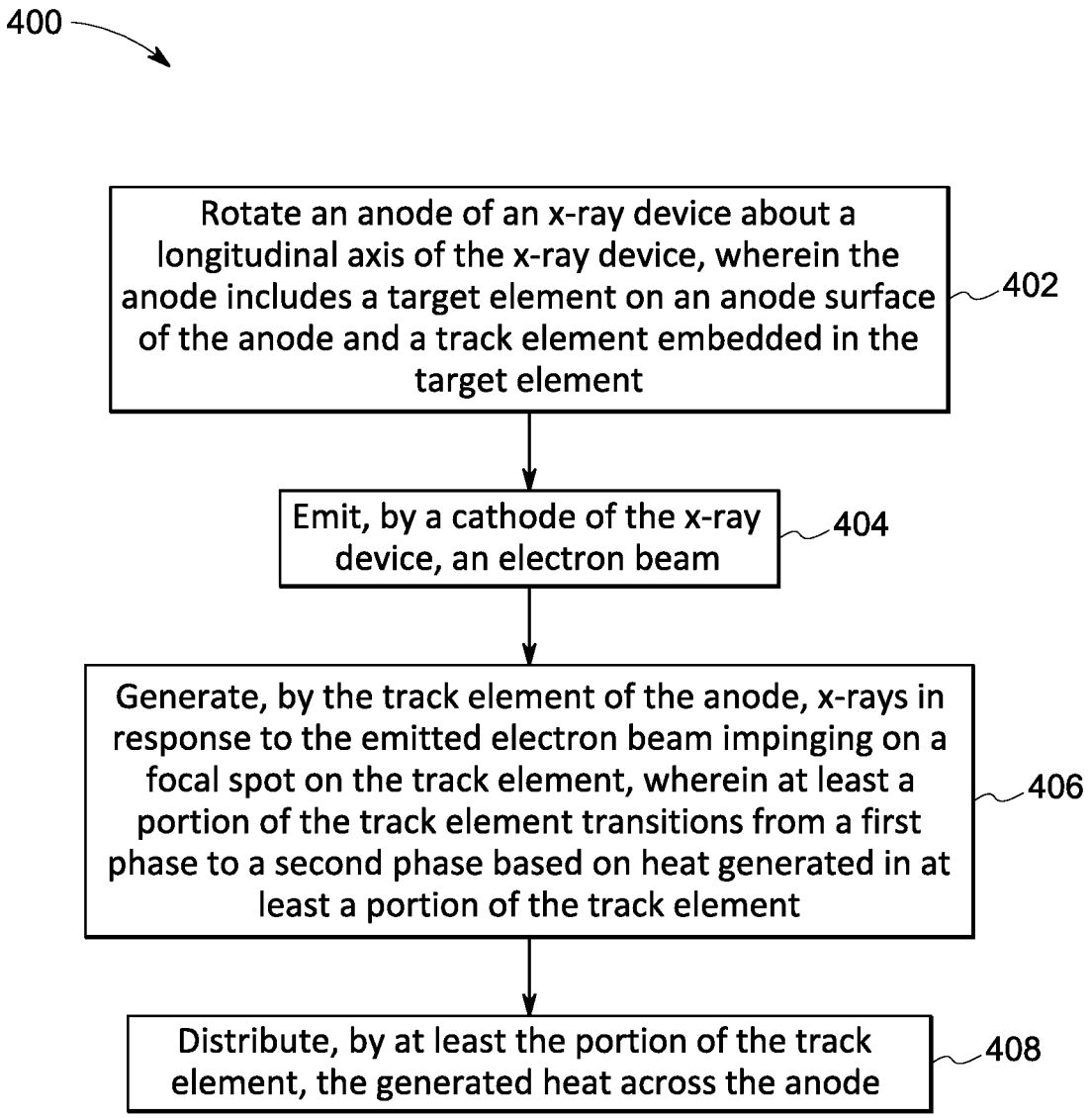
FIG. 4 is a flow chart illustrating a method for improving x-ray production in the x-ray device of FIG. 1, in accordance with aspects of the present specification.

Turning now to FIG. 4, a flow chart 400 illustrating a method for improving x-ray production in an x-ray device, in accordance with aspects of the present specification, is depicted. In particular, the method entails enhancing the production of x-rays in the x-ray device by maintaining the anode without any degradation and distributing heat generated in the anode. For ease of understanding, the method 400 is described with reference to the components of FIGS. 1-3.

The method begins at step 402, where the anode 110 is rotated about the longitudinal axis 120 of the x-ray device 104. In one embodiment, the bearing unit 122 is operatively coupled to the anode 110 and configured to rotate the anode 110 about the longitudinal axis 120 of the x-ray device 104. Also, the anode 110 includes the target element 142 that is disposed on the anode surface 126 of the anode 110. Further, the track element 140 is embedded in the target element 142.

Subsequently, at step 404, the cathode 108 of the x-ray device 104 emits the electron beam 118. In particular, the cathode 108 generates electrons that are accelerated towards the anode surface 126 of the anode 110 by applying the high voltage potential between the cathode 108 and the anode 110.

Subsequently, at step 406, x-rays 130 are generated by the track element 140 in response to the electron beam 118 impinging on a focal spot on the track element 140. In particular, the electron beam 118 impinges upon the track element 140 at the focal spot 302 and releases kinetic energy in the form of electromagnetic radiation of very high frequency, i.e., the x-rays. These x-rays 130 emanate in all directions from the track element 140. A portion 132 of these x-rays passes through the x-ray window 112 in the vacuum envelope 106 and through the x-ray window 114 of the housing 102 to exit the x-ray system 100.

Furthermore, the impinging electron beam 118 may generate heat in the track element 140. Consequently, at least a portion of the track element 140 transitions from the first phase to the second phase based on the heat generated in the track element 140. More specifically, the heat generated in the track element 140 may increase the temperature of the track element 140. If the temperature of the track element 140 exceeds the first threshold value, at least a portion of the track element 140 melts and transitions from the first phase to the second phase.

In addition, at step 408, the generated heat is distributed across the anode 110 when the anode 110 is rotated about the longitudinal axis 120 of the x-ray device 104. In particular, at least the portion of the track element 140 distributes the heat across the anode 110. More specifically, the track element 140 absorbs the generated heat when the track element 140 is transitioned from the first phase to the second phase. As the anode 110 is rotated over the longitudinal axis 120 of the x-ray device 104, the track element 140 may distribute the absorbed heat across the anode 110. In one embodiment, the coolant in the housing 102 may direct this heat away from the x-ray device 104.

The various embodiments of the x-ray systems and the x-ray devices in particular and the method aid in generating the x-rays without degrading the anode. Also, the heat generated in the anode is distributed across the anode, thereby minimizing any damage to the anode and enhancing the efficiency of generating the x-rays. Moreover, with the exemplary structures and methods, the anode is maintained without cracks or pits, which in turn improves the efficiency of generation of x-rays in the x-ray device.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. An x-ray device, comprising:

a cathode configured to emit an electron beam;

an anode configured to rotate about a longitudinal axis of the x-ray device and positioned to receive the emitted electron beam, wherein the anode comprises:

a target element disposed on an anode surface of the anode; and a track element embedded in the target element, wherein the track element is configured to generate x-rays in response to the emitted electron beam impinging on a focal spot on the track element, wherein at least a portion of the track element is configured to transition from a first phase to a second phase based on heat generated in at least a portion of the track element, and wherein at least the portion of the track element is configured to distribute the generated heat across the anode.

2. The x-ray device of claim 1, further comprising a bearing unit operatively coupled to the anode and configured to rotate the anode about the longitudinal axis of the x-ray device.

3. The x-ray device of claim 1, wherein at least the portion of the track element is configured to distribute the generated heat across the anode when the anode is rotated about the longitudinal axis of the x-ray device.

4. The x-ray device of claim 1, wherein the track element is embedded in the target element at a determined angle with respect to the longitudinal axis of the x-ray device to optimize the focal spot on the track element.

5. The x-ray device of claim 1, wherein the track element is embedded proximate to an outer surface of the target element such that the emitted electron beam penetrates through the target element and impinges on the focal spot on the track element.

6. The x-ray device of claim 1, wherein the target element includes a void adjacent to the track element, and wherein at least the portion of the track element is configured to expand into the void when at least the portion of the track element transitions from the first phase to the second phase.

7. The x-ray device of claim 1, wherein the target element comprises at least one of graphite or a diamond material, and wherein the track element comprises a lead material.

8. The x-ray device of claim 1, wherein at least the portion of the track element is configured to transition from the first phase to the second phase when a temperature of the track element exceeds a first threshold value.

9. The x-ray device of claim 1, wherein at least the portion of the track element is configured to transition from the second phase to a third phase when the temperature of the track element exceeds a second threshold value.

10. An x-ray system comprising the x-ray device of claim 1.

11. The x-ray system of claim 10, further comprising a housing and a vacuum envelope configured to enclose the cathode and the anode, wherein at least a portion of the x-ray device is disposed in the housing and the vacuum envelope comprises an x-ray window aligned with an x-ray window of the housing to convey the generated x-rays towards an object of interest.

12. The x-ray system of claim 11, wherein the track element is embedded in the target element at a determined angle with respect to the longitudinal axis of the x-ray device to optimize the focal spot on the track element.

13. The x-ray device of claim 11, wherein the track element is embedded proximate to an outer surface of the target element such that the emitted electron beam penetrates through the target element and impinges on the focal spot on the track element.

14. A method for improving x-ray production in an x-ray device, the method comprising:

rotating an anode of the x-ray device about a longitudinal axis of the x-ray device, wherein the anode comprises a target element disposed on an anode surface of the anode and a track element embedded in the target element;

emitting an electron beam;

generating, by the track element of the anode, x-rays in response to the emitted electron beam impinging on a focal spot on the track element, wherein at least a portion of the track element transitions from a first phase to a second phase based on heat generated in at least a portion of the track element; and distributing, by at least the portion of the track element, the generated heat across the anode.

15. The method of claim 14, further comprising coupling the anode to a bearing unit to rotate the anode about the longitudinal axis of the x-ray device.

16. The method of claim 14, further comprising embedding the track element in the target element at a determined angle with respect to the longitudinal axis of the x-ray device to optimize the focal spot on the track element.

17. The method of claim 14, further comprising embedding the track element proximate to an outer surface of the target element such that the emitted electron beam penetrates through the target element and impinges on the focal spot on the track element.

18. The method of claim 14, further comprising expanding at least the portion of the track element into a void adjacent to the track element when at least the portion of the track element transitions from the first phase to the second phase.

19. The method of claim 14, wherein at least the portion of the track element is transitioned from the first phase to the second phase when a temperature of the track element exceeds a first threshold value.

20. The method of claim 14, wherein at least the portion of the track element is transitioned from the second phase to a third phase when the temperature of the track element exceeds a second threshold value.

* * * * *